US005742944A

United States Patent [19]

Pfefferman

[11] Patent Number: 5,742,944

[45] Date of Patent: Apr. 28, 1998

[54] COMBINED CAP AND CARRYING BAG

[76] Inventor: Erich S. Pfefferman, 11524 Pala Mesa Dr., Northridge, Calif. 91326

[21] Appl. No.: 398,005

[22] Filed: Mar. 3, 1995

[51] Int. Cl.[6] ..... A42B 1/06

[52] U.S. Cl. ..... 2/209.12; 2/172; 2/195.1; 2/209.13; 150/106; 383/4

[58] Field of Search ..... 2/10, 12, 171, 2/171.1, 171.4, 171.5, 171.7, 171.8, 172, 175.1, 195.1, 209.11, 209.12, 209.13; 150/100, 103, 106, 119; 383/4

[56] References Cited

U.S. PATENT DOCUMENTS 3,496,575 2/1970 Neckermann et al. ..... 2/171
3,505,682 4/1970 Mims ..... 2/171.1
5,487,191 1/1996 Ridley ..... 2/195.1
5,507,205 4/1996 Ruimi ..... 2/209.12

*Primary Examiner*—Diana Biefeld
*Attorney, Agent, or Firm*—Allan M. Shapiro

[57] ABSTRACT

A visored cap is disclosed herein with a crown having an internal storage compartment when not being worn by the user and is provided with an elongated or cutout opening in the visor for grasping as a carrying handle by the user. A detachable cover is carried about the sweatband of the cap crown for enclosing the internal storage compartment when used for storage. The visor includes a sliding panel, a pivotal panel or a snap-on panel for selectively closing the cutout opening when the cap is worn by the user wherein the panel is translucent or transparent for accommodating visual observation. The closure for the cover with the cap crown may be of zippered or hook and pile construction.

5 Claims, 2 Drawing Sheets

FIG. 1
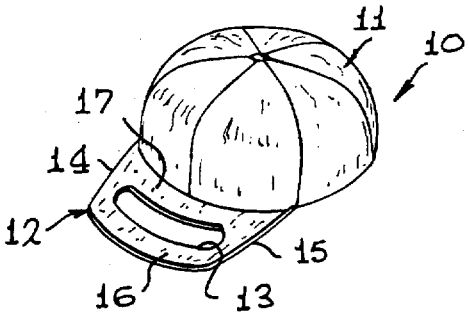
FIG. 2
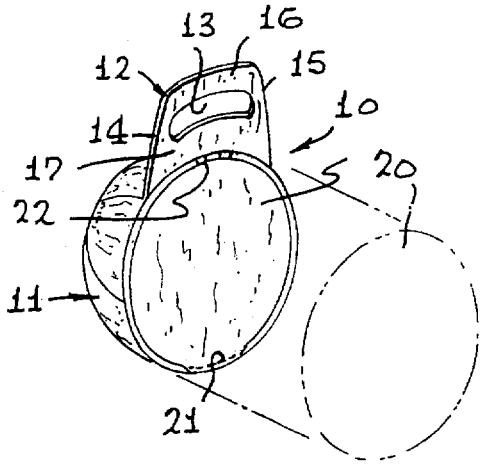
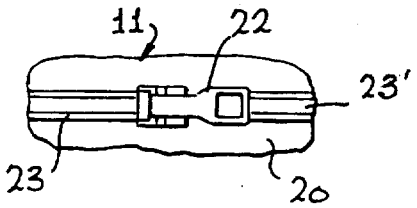
FIG. 4
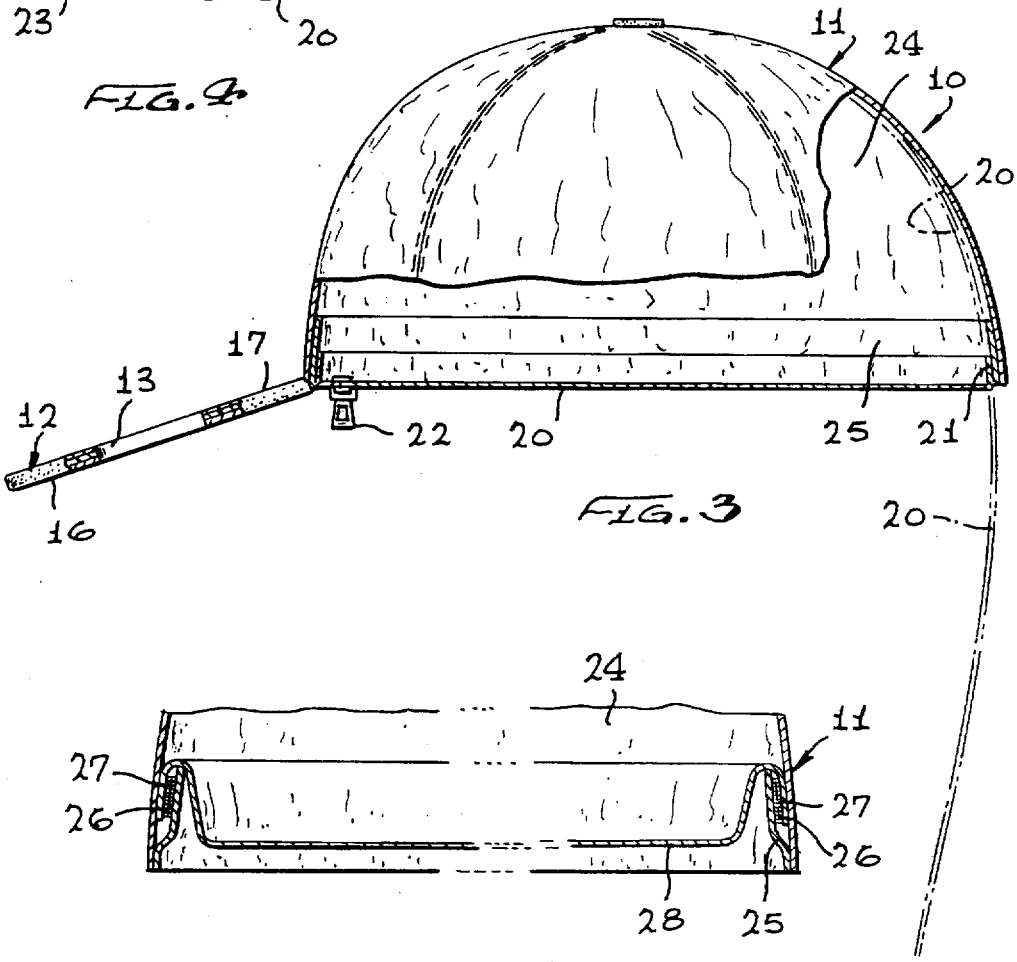
FIG. 3
FIG. 5

COMBINED CAP AND CARRYING BAG

BACKGROUND OF THE INVENTION

1. Field of the Invention

The present invention relates to the field of garments, and headgear in particular, and more directly to a novel cap having an internal storage compartment within the crown of the cap and having a visor constructed to serve as a handle for carrying purposes and alternatively provided with a transparent or translucent section through which visual observation can be taken.

2. Brief Description of the Invention

In the past, it has been the conventional practice to provide headgear, such as caps, with a visor and a crown. When worn by the user, the crown fits over the top of the user's head with the visor outwardly projecting so as to shade or protect the wearer's eyes. The visor is composed of a solid material and the crown includes a sweatband or liner which follows around the opening into the crown so as to support the cap on the head of the user. Conventionally, the cap is only employed to cover the user's head while the visor is used solely to shade or protect the user's eyes. Some attempts have been made to augment the cap by employing pivotal colored panels on the underside of the visor so that the user may readily "flip" the panel downwardly so that the panel will shield the eyes from undesired glare.

Although such "flip" panels or glasses may service the purpose of an anti-glare device, such means are merely add-ons to the visor and do not affect the construction or usage of the visor or the cap itself. In other words, there is no structural adaptation or modification required to mount the panel onto the visor itself. The panel is not used for any other purpose or accommodation.

Furthermore, the inside of the conventional crown serves no additional purpose than to accommodate the head of the user and the headband or liner forms a fit to the head of the user so that the wearing of the cap is comfortable. However, when not worn by the user, the cap is not easily carried and serves no other purpose. In fact, when the user is attending a sports event, for example, the user must carry storage bags, binocular cases or the like as separate items. The cap is one of the additional items and, as such, becomes awkward and cumbersome to carry.

Therefore, a long-standing need has existed to provide a cap which not only may serve the conventional purposes as a head covering and eye shade but can also accommodate the storage of small items, and which provides a variety of options for providing glare reduction to the user when worn as a cap.

SUMMARY OF THE INVENTION

Accordingly, the above problems and difficulties are avoided by the present invention which provides a novel combination visored cap, storage compartment and carrying handle which comprises a domed crown having an outwardly projecting visor and which includes a continuous sweatband mounted about an opening into the interior of the crown. The invention includes the provision of a cover which is detachably carried on the crown at the sweatband whereby means are provided for detachably connecting the cover thereto. Preferably, a portion of the cover is permanently attached at the back of the crown while the remaining portion of the cover is detachably connected about the sweatband or rim of the crown by means of a zipper or a hook and pile fastening means. When not worn by the user, the crown becomes a storage compartment enclosed by the detachable cover. However, when worn by the user, the crown fits the head of the user void of any stored contents. The invention further includes a visor having an elongated cutout opening which serves as a handle in order to carry the cap including items stored within the internal storage compartment. The visor includes a translucent or transparent panel which selectively covers the cutout opening in order to shield or protect the eyes of the user when the cap is worn. The panel may be mounted on the visor so as to slide through a slit opening for retention on the visor or the panel may be pivotally carried on the top of the visor for adjustment by the user.

It is among the primary objects of the present invention to provide a novel combined cap and carrying bag which has alternate conditions of use. In one condition, the cap maybe worn on the head of the user with the visor shielding the eyes of the user, and in another condition, the cap may be used as a carrying bag housing a variety of small articles within the crown of the cap by means of a closable cover.

Another object of the present invention is to provide a novel combined cap and carrying bag which has a novel visor, including a cutout opening that is covered by a translucent or transparent panel of colored pigmentation wherein the panel may be arranged in a sliding relationship on the visor with respect to the opening or may be pivotally carried on the visor for selectively covering the opening. Another version envisions a snap-on arrangement for the panel with respect to the visor for covering the opening.

Another object of the present invention is to provide a novel piece of headgear which may also serve as a carrying bag when not worn by the user, and which includes a detachably mounted cover with respect to the crown so that a storage compartment is defined within the crown when the cover is closed.

Another object of the present invention is to provide a novel alternative use for a cap which takes the form of a carrying bag wherein the crown of the cap serves as a storage compartment in combination with a detachable cover and the visor of the cap serves as a handle for carrying the cap as a storage bag.

The features of the present invention which are believed to be novel are set forth with particularity in the appended claims. The present invention, both as to its organization and manner of operation, together with further objects and advantages thereof, may best be understood with reference to the following description, taken in conection with the accompanying drawings.

BRIEF DESCRIPTION OF THE DRAWINGS

FIG. 1 is a front perspective view showing the inventive cap and carrying bag of the present invention;

FIG. 2 is a perspective view illustrating the inventive cap and carrying bag in its condition for storing articles within the crown of the cap;

FIG. 3 is an enlarged longitudinal cross-sectional view, partly in broken away elevation, of the combined cap and carrying bag with a zipper closure for the cover;

FIG. 4 is a fragmentary elevational view of the zipper closure of FIG. 3 for detachably connecting the cover to the crown of the cap;

FIG. 5 is a transverse cross-sectional view of the crown of a cap illustrating a hook and pile attachment for the cover to the crown of the cap;

DESCRIPTION OF THE PREFERRED EMBODIMENT

Figure 6:
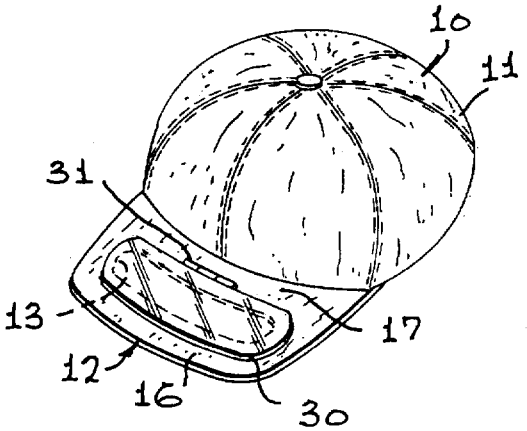
FIG. 6 is a front perspective view of the combined cap and carrying bag illustrating a pivotable panel for selectively covering the handle opening in the visor.

Referring to FIG. 1, the novel combined cap and carrying bag incorporating the present invention is illustrated in the general direction of arrow 10 and includes a crown 11 having a forward facing visor 12 which outwardly projects from the front of the cap. The crown may be of a solid material or may be segmented, as illustrated, and the visor or peak 12 is preferably composed of a stiffened material so as to be rigid or semi-rigid in order to shield the eyes of the wearer. As is practiced with conventional caps, the crown 11 is intended to fit over the top of the head while the forward facing visor projects beyond the front of the user's face. The visor 12 is provided with an elongated cutout opening 13 which is defined between side edge marginal regions 14 and 15 as well as a forward edge marginal region 16 and a rearward edge region 17. When the cap is worn by the user, the user may glance upwardly through the opening 13 for observation purposes and light is also permitted to pass through the opening so that the user's face is not completely shielded. Shielding means will be described with respect to other versions later in this specification. However, when the combined cap and carrying bag 10 is used for a carrying bag purpose, the forward edge marginal region 16 and the opening 13 constitute a handle which may be readily grasped by one hand of the user.

In connection with the usage of the invention as a carrying bag, reference is made to FIG. 2 wherein it can be seen that the rigid or semi-rigid visor 12 extends upwardly so that the crown 11 downwardly extends therefrom. The crown includes an interior storage compartment which is sealed by a detachable cover 20. The edge marginal region of the cover is fixedly secured to an edge of the crown, as indicated by numeral 21, and the stitch lines shown. Such attachment occurs at the sweatband region of the crown which is continuous about the opening into the storage area of the crown which is covered by cover 20. The cover is detachably connected to the remaining portion of the sweatband by a closure means such as a zipper closure 22. In broken lines, the cover 20 is illustrated as being detached from the sweatband of the crown 11. Regarding the zippered closure 22, it can be seen that the zipper is of a double type so that either a left or right side of the cover may be detached or separated from the sweatband. However, for gaining greater access for storage purposes, the zipper closure may be opened on both sides so that the cover 20 is solely attached to the cap by the stitching 21. In FIG. 4, for example, the zipper 22 is illustrated as being detachably coupled between the crown or peak 11 and the peripheral edge of the cover 20. The zipper follows tracks 23 and 23' in accordance with conventional zipper practice.

Referring now in detail to FIG. 3, the cap and carrying bag combination 10 is illustrated wherein it can be seen that the interior of the crown 11 includes an inner storage compartment generally indicated by numeral 24 and that the open entrance leading into the compartment is defined by the circular sweatband 25. In solid lines, the cover 20 is attached to the edge marginal region of the sweatband 25 by the zipper closure 22; however, as shown in one set of broken lines, the cover 20 is in a downwardly depending position from its stitching 21 so that the cover in such a position may represent a neck flap when the cap is worn by the user; as shown in another set of broken lines, the cover 20 is in an upwardly extending position from its stitching 21 so that the cover 20 lays inside the crown 11 and remains there when the cap is worn by the user. Preferably, the forward projecting visor 12 is arranged at a downwardly sloping angle for the convenience of the wearer.

Referring now in detail to FIG. 5, another embodiment of the invention is illustrated wherein the closure for the cover comprises a hook and pile fastening means, such as "VELCRO" or the like. In this embodiment, the sweatband 25 includes one-half of the closure, such as a layer of pile material 26, while the hook material 27 is carried on the edge marginal region of a cover 28. Therefore, it can be seen that the sweatband 25 need only be folded outwardly so that the other half of the fastener carried on the cover 28 can be attached thereto followed-by folding of the sweatband back into its position so that the cover closes the opening into the inner storage compartment 24. Such a provision also permits the user to store the cover 28 within the storage area 24 so that the cap may be worn on his head when the cap is not being used as a carrying bag.

Figure 7:
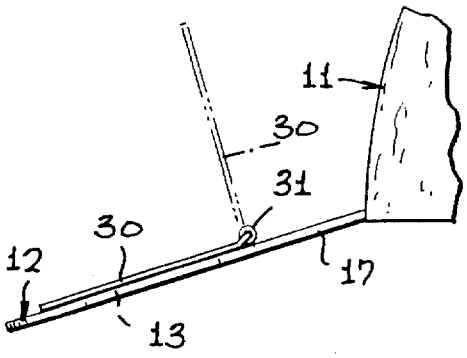
FIG. 7 is a side elevational view greatly enlarged, illustrating the pivotal action of the panel of FIG. 6 between its open position in broken lines and closed position in solid lines.

Referring to FIGS. 6 and 7, another embodiment of the present invention is illustrated wherein the combined cap and carrying bag 10 includes a transparent, translucent or opaque panel 30 which is mounted by hinge 31 to the upper surface of the visor 12. The hinge 31 is secured to the rearward edge marginal region 17 of the visor so that the panel 30 may be raised or lowered with respect to the opening 13. The panel 30 is longer than the opening 13 so that the edge marginal regions of the panel will bear against or rest against the upper surface of the visor which surrounds or defines the opening 13. Therefore, the overlapping of the edge marginal regions of the panel, when engaged with the visor, constitutes a stop whereby the opening is completely closed. As shown more clearly in FIG. 7, the broken line showing of panel 30 is in its fully open position so that the panel is not a barrier or sight limitation, and the forward edge marginal region 16 and the opening 13 then are available as a handle.

Figure 8:
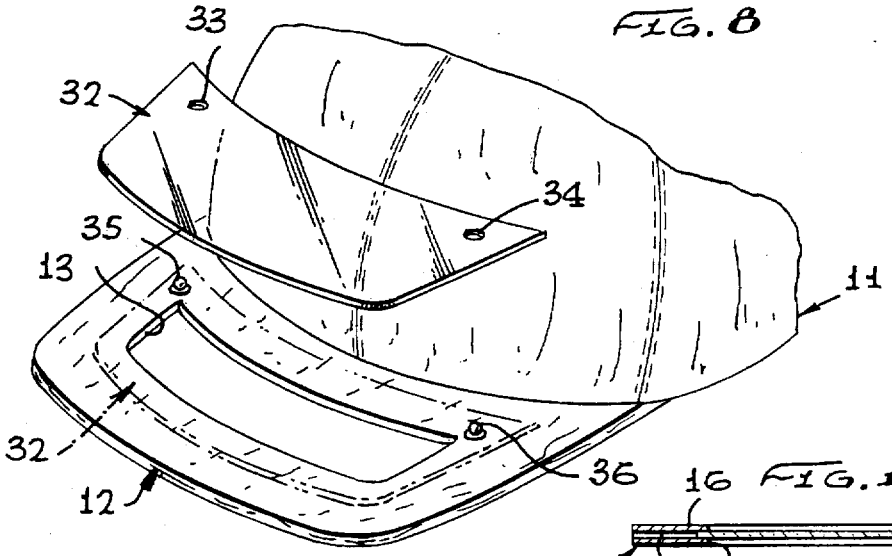
FIG. 8 is an exploded fragmentary perspective view of another embodiment of the combined cap and carrying bag, illustrating a snap-on panel for covering the handle opening in the visor.

Referring to FIG. 8, another barrier for opening 13 is disclosed, which takes the form of panel 32 which includes openings 33 and 34 for receiving snap studs 35 and 36 respectively. As shown in broken lines, the panel 32 is positioned over the opening 13 and the receptacles 33 and 34 are fully snaplocked with the studs 35 and 36. In this manner, the panel is detachably connected with respect to the visor 12.

Figure 10:
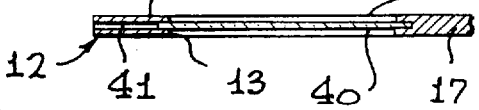
FIG. 10 is a cross-sectional view of the visor shown in FIG. 9 taken in the direction of arrows 10—10.
Figure 9:
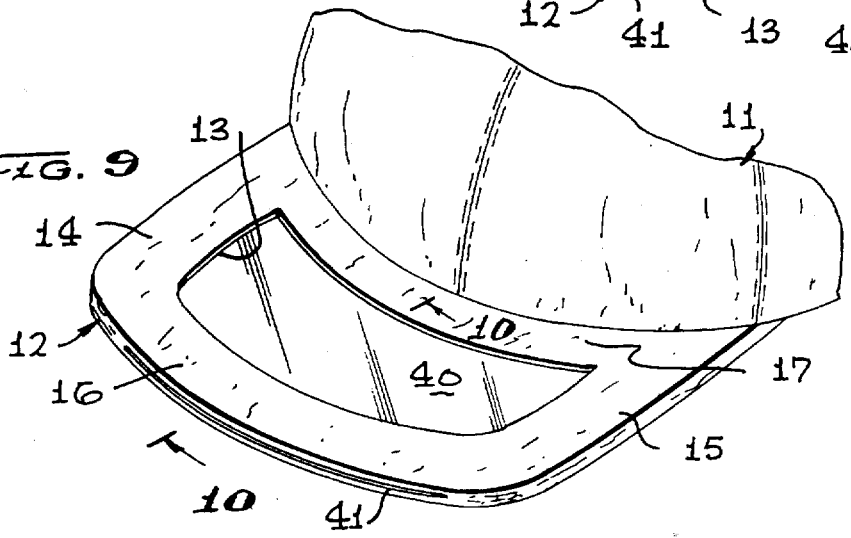
FIG. 9 is a fragmentary perspective view of still another version of a panel for closing the handle opening taking the form of a sliding mount for the panel.

Referring now in detail to FIGS. 9 and 10, another version of the invention is illustrated wherein the means for covering the opening 13 takes the form of a panel 40 that may be insertably received through a slot opening 41 in the extreme front portion of the visor 12. The slot opening or entrance 41 leads the edge marginal regions of the panel along guides or tracks on the side marginal regions 14 and 15 of the visor, as shown more clearly in FIG. 10. FIG. 10 also illustrates the slot opening 41 for receiving the edge of panel 40 when it is inserted through the slot 41 and along the edge marginal slots of the visor. The edge of the panel introduced through the slot 41 will bear against the inner marginal region 17 of the visor, which forms a stop so that the panel cannot be slid any further into position.

In view of the foregoing, it can be seen that the combined cap and carrying bag of the present invention provides a novel cap with protective visor and carrying bag with convenient handle. When employed as a cap, the opening which normally would be used as a handle in the visor for carrying the bag may be closed in a variety of ways, such as employment of the panels shown in FIGS. 6, 8 and 9. The panel may be translucent, transparent or opaque and a variety of attachment and securing means is disclosed. When employed as a carrying bag, the embodiment of the invention is shown in FIGS. 1, 2 and 3 whereby the cover may be fully closed to secure articles intended to be carried which are within the internal storage compartament in the crown. Also, the cover may be partially more fully secured to the crown of the cap by a variety of closures such as zippers or hook and pile fastening means. The cover may be used as a neck flap when partially detached from the crown of the cap and the cover may be readily stored on the inside of the crown so that the cap may be worn on the head of the user and will not interfere with the fit or appearance of the cap. The user has the option of either leaving the opening 13 free or a barrier, such as the panels disclosed in FIGS. 6–10, may be employed.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A combined cap and carrying bag comprising:

a cap construction having a domed crown supporting an outwardly projecting visor;

said crown having an interior storage compartment terminating at a circular edge coextensive with said visor;

a cover detachably carried on said crown at its circular edge and having an open position permitting access to said internal storage compartment and a closed position blocking access to said internal storage compartment;

said visor having an elongated opening defined by a pair of side edge marginal regions joined by a front edge marginal region;

said cap construction including said visor and said crown constitutes a cap to be worn by a user when said cover is in its open position;

said cap construction constitutes a carrying bag when said cover is in its closed position, with said visor and said elongated opening being a handle and said crown and said cover being a bag;

closure means cooperatively carried on said crown edge and said cover for detachably connecting said cover to said crown; and said cover having a first portion attached to said crown at a location opposite from said visor and having a second portion of said cover which, in said open position, depends from said crown and said first portion.

2. The combined cap and carrying bag as defined in claim 1 wherein:

said closure means is a zipper having closure tracks carried on adjacent and opposing sections on said cover and said crown edge.

3. The combined cap and carrying bag as defined in claim 1 including:

an elongated panel operably mounted on said visor to selectively cover said elongated opening.

4. The combined cap and carrying bag as defined in claim 3 wherein:

said panel is selected from a material having characteristics chosen from:

a. opaque material b. translucent material c. transparent material.

5. The combined cap and carrying bag as defined in claim 4 including:

snap-fastener means detachably connecting said panel to said visor.

* * * * *